US008844610B2

(12) United States Patent
Platt

(10) Patent No.: US 8,844,610 B2
(45) Date of Patent: Sep. 30, 2014

(54) DOUBLE INLET HEAT EXCHANGER

(75) Inventor: Mark Platt, Sparta, WI (US)

(73) Assignee: Multistack, LLC, Sparta, WI (US)

( * ) Notice: Subject to any disclaimer, the term of this patent is extended or adjusted under 35 U.S.C. 154(b) by 435 days.

(21) Appl. No.: 12/511,325

(22) Filed: Jul. 29, 2009

(65) Prior Publication Data

US 2010/0065262 A1 Mar. 18, 2010

Related U.S. Application Data

(60) Provisional application No. 61/098,223, filed on Sep. 18, 2008.

(51) Int. Cl.

| | |
|---|---|
| ***F28D 7/02*** | (2006.01) |
| ***F28F 3/00*** | (2006.01) |
| ***F28F 3/08*** | (2006.01) |
| ***F28D 9/00*** | (2006.01) |
| *F28F 3/04* | (2006.01) |

(52) U.S. Cl.
CPC *F28D 9/005* (2013.01); *F28F 3/046* (2013.01)
USPC ..... 165/167; 165/164; 165/165; 165/166

(58) Field of Classification Search
USPC ..... 165/139, 164–167
See application file for complete search history.

(56) References Cited

U.S. PATENT DOCUMENTS

| | | | | |
|---|---|---|---|---|
| 2,813,701 | A * | 11/1957 | Fenger | 165/147 |
| 3,117,624 | A * | 1/1964 | Wennerberg | 165/167 |
| 3,960,210 | A * | 6/1976 | Chartet | 165/149 |
| 4,535,840 | A * | 8/1985 | Rosman et al. | 165/167 |
| 5,226,474 | A * | 7/1993 | Hallgren | 165/110 |
| 6,328,098 | B1 * | 12/2001 | Kodumudi et al. | 165/149 |
| 6,389,696 | B1 * | 5/2002 | Heil et al. | 29/890.039 |
| 6,752,202 | B2 * | 6/2004 | Holm et al. | 165/167 |
| 7,287,579 | B2 * | 10/2007 | Dilley et al. | 165/167 |
| 2002/0023735 | A1 * | 2/2002 | Uchikawa et al. | 165/81 |
| 2002/0029869 | A1 * | 3/2002 | Kodumudi et al. | 165/81 |
| 2004/0226703 | A1 * | 11/2004 | Blomgren | 165/166 |
| 2006/0185824 | A1 * | 8/2006 | Harada | 165/81 |
| 2007/0012424 | A1 * | 1/2007 | Kamiya et al. | 165/81 |
| 2007/0163751 | A1 * | 7/2007 | Balci et al. | 165/81 |
| 2007/0199680 | A1 * | 8/2007 | Helms et al. | 165/81 |
| 2007/0261820 | A1 * | 11/2007 | Rousseau et al. | 165/81 |
| 2008/0006392 | A1 * | 1/2008 | Hayasaka et al. | 165/81 |
| 2008/0047689 | A1 * | 2/2008 | Hirose et al. | 165/81 |
| 2008/0169090 | A1 * | 7/2008 | Riondet et al. | 165/149 |
| 2011/0024081 | A1 * | 2/2011 | Riondet et al. | 165/81 |

* cited by examiner

*Primary Examiner* — Alexandra Elve
*Assistant Examiner* — Henry Crenshaw
(74) *Attorney, Agent, or Firm* — Orum Roth, LLC; Keith H. Orum

(57) ABSTRACT

The present invention is a plate heat exchanger that allows refrigerant to enter the heat exchanger simultaneously from two sides. Allowing the refrigerant or other fluid to enter from two sides splits the flow and improves fluid velocities by presenting an optimized area to the fluid flow. This effect may be realized for both gases and liquids, and for example with respect to a liquid refrigerant, where it enters the heat exchanger simultaneously by splitting. According to the present invention the split liquid flow from the condenser feeds dual electronically controlled expansion valves before entering the heat exchanger. Fully evaporated gas leaves the heat exchanger through a single outlet, or through a dual outlet.

4 Claims, 3 Drawing Sheets

DOUBLE INLET HEAT EXCHANGER

BACKGROUND OF THE INVENTION

Field of the Invention

This invention relates to improvements in plate heat exchangers.

DESCRIPTION OF THE RELATED ART

In the past, plate heat exchangers suffered from a disadvantage known as maldistribution of heat. This problem essentially is that the fluids involved in the heat transfer are not distributed in the most efficient manner in order to increase the efficiency of the heat transfer itself between the fluids. In the past, this maldistribution effect was compensated for by simply enlarging the size of the heat exchangers which increases the capacity and heat transfer surface areas. Increased surface area for heat transfer however does not actually solve the problem of mal-distribution, but masks it by allowing for the necessary heat transfer required for an application, but only by enlarging the inefficiently utilized surface areas of the heat exchanger suffering from the maldistribution problem. Mal-distribution may be attributed to the fluid's inability to fully utilize all of the presented heat transfer areas because of low velocities and low turbulence in the fluids, and unoptimized temperature gradients.

BRIEF SUMMARY OF THE INVENTION

In the present invention, it has been found that mal-distribution can be addressed and overcome by allowing the fluid such as the refrigerant to enter the heat exchanger simultaneously from two sides. Allowing the refrigerant or other fluid to enter from two sides splits the flow and improves fluid velocities by presenting a different area to the fluid flow. By doing so, turbulence is maintained, good heat transfer is maintained, maldistribution is avoided. This effect may be realized for both gases and liquids, and for example with respect to a liquid refrigerant, where it enters the heat exchanger simultaneously by splitting. According to the present invention the split liquid flow from the condenser feeds dual electronically controlled expansion valves before entering the heat exchanger. Fully evaporated gas leaves the heat exchanger through a single outlet, or through a dual outlet.

In the present invention, in particular, it has been found that allowing the refrigerant to enter the heat exchanger simultaneously from two opposite sides of the inlet end of a heat exchanger is a substantial improvement with respect to the mal-distribution problem.

In one embodiment, the heat exchanger is a plate heat exchanger. It may be employed as an evaporator for refrigerant.

In the present invention, a larger volume of the incoming refrigerant is exposed to a larger heat exchange area more rapidly and at an advantageous temperature and pressure condition as it enters the exchanger. This new structure takes more full advantage of the typically-shaped plate heat exchanger which is comprised normally of uniform sized and shaped plates. In the prior art, the temperature and flow characteristics of refrigerant entering the exchanger from a single inlet is changing in a degrading fashion as the incoming fluid flows farther into the exchanger before it has the opportunity to pass along the surface of each heat exchanging plate, as it makes its way to the exit point at the opposite end of each plate.

In the present invention, the refrigerant is presented to the entrance side of each heat exchanging plate in a temperature and flow condition which promotes more efficient heat transfer. Specifically, the present invention increases fluid velocities, turbulence characteristics, and temperature differential across the surface of more of the plates in the exchanger.

The configuration may include the preferred embodiment comprising a dual inlet single outlet for the refrigerant, or may also comprise a dual inlet dual outlet for the refrigerant. An alternate embodiment configuration having a single inlet and dual outlet for refrigerant is also contemplated whereby a reduction in outlet back pressure also facilitates the more rapid introduction of inlet fluid.

BRIEF DESCRIPTION OF THE SEVERAL VIEWS

DETAILED DESCRIPTION OF THE INVENTION

Figure 1:
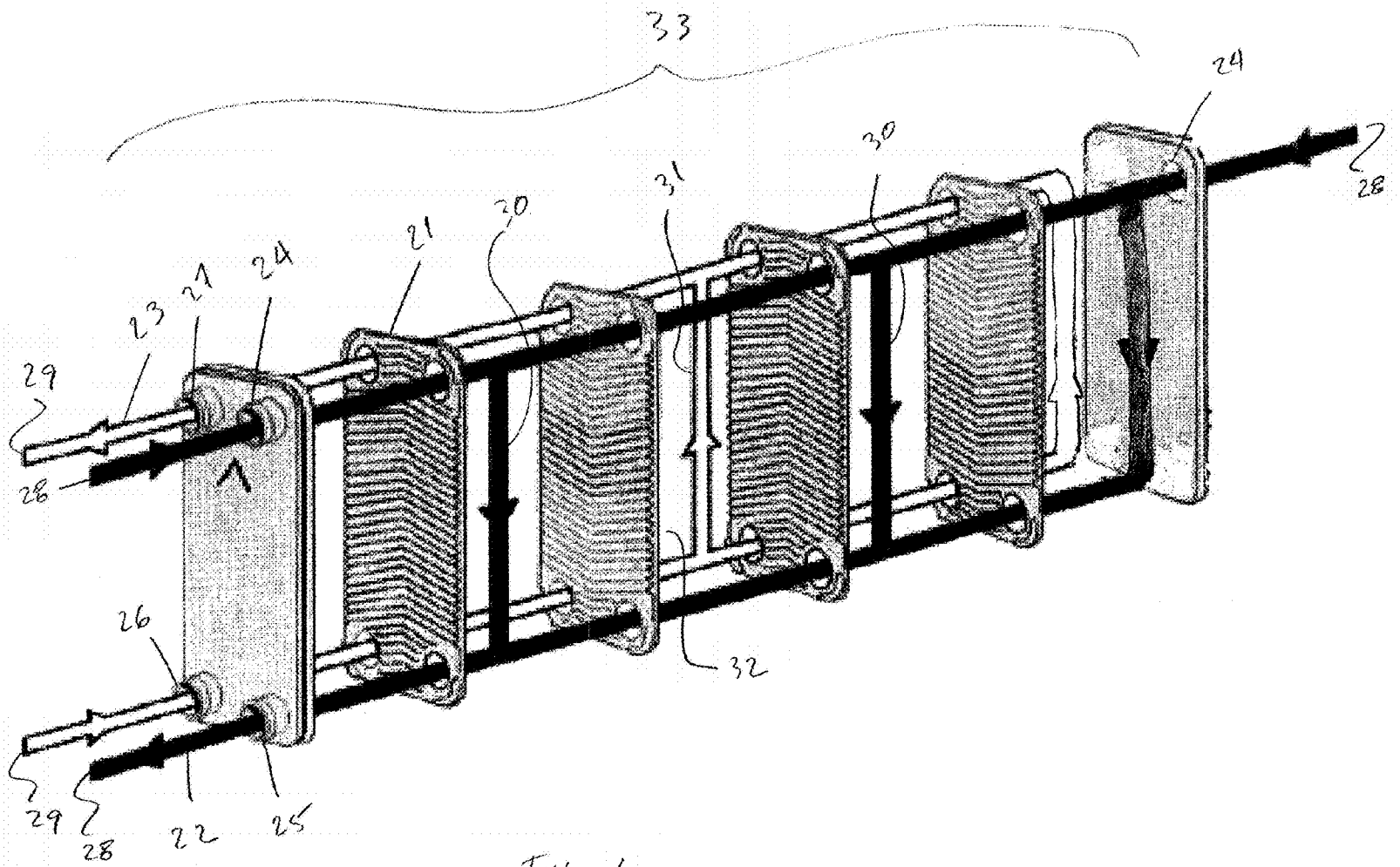
FIG. 1 is a perspective/schematic view of one embodiment, shown expanded.

In FIG. 1, a first embodiment of the invention is illustrated. This view is an exploded view of one embodiment. Specifically, in this one embodiment, a refrigerant double inlet single outlet system 33 is shown.

Referring to FIG. 1, a series of heat exchanger plates 21 are arranged to form a plate heat exchanger 33.

First fluid refrigerant 22 enters the device along first fluid flow paths 28 at first fluid inlet ports 24 and exits the device at first fluid outlet port 25. In this embodiment, the device includes at least two inlet ports, 24, and one outlet port 25. The second fluid to be conditioned 23, which may be a liquid such as water, or water-containing mixture, or compounds, enters the device through a second fluid inlet port 26, along second fluid flow path 29, and exits the device at second fluid outlet port 27.

Typically, the first fluid refrigerant 22 and the second fluid to be conditioned 23 travel through the device through alternate heat exchanging plate gaps 32 such that a heat exchanging plate 21 separates the fluids from each other. Heat is transferred from one fluid to the other through the plates.

The bulk of the heat exchanging effect occurs as the first fluid refrigerant 22 and second fluid to be conditioned 23 travel through first fluid heat exchanging flow path 30 and second fluid heat exchanging flow path 31 respectively. Often, the direction of flow of the two fluids are counter to each other, to enhance the exchange of heat across the plates.

The refrigerant is thereby introduced at two inlet ports on opposite ends of the plate heat exchanger, and in this embodiment, the refrigerant exits at a single point shown in FIG. 1 as first fluid outlet port 25.

Figure 2:
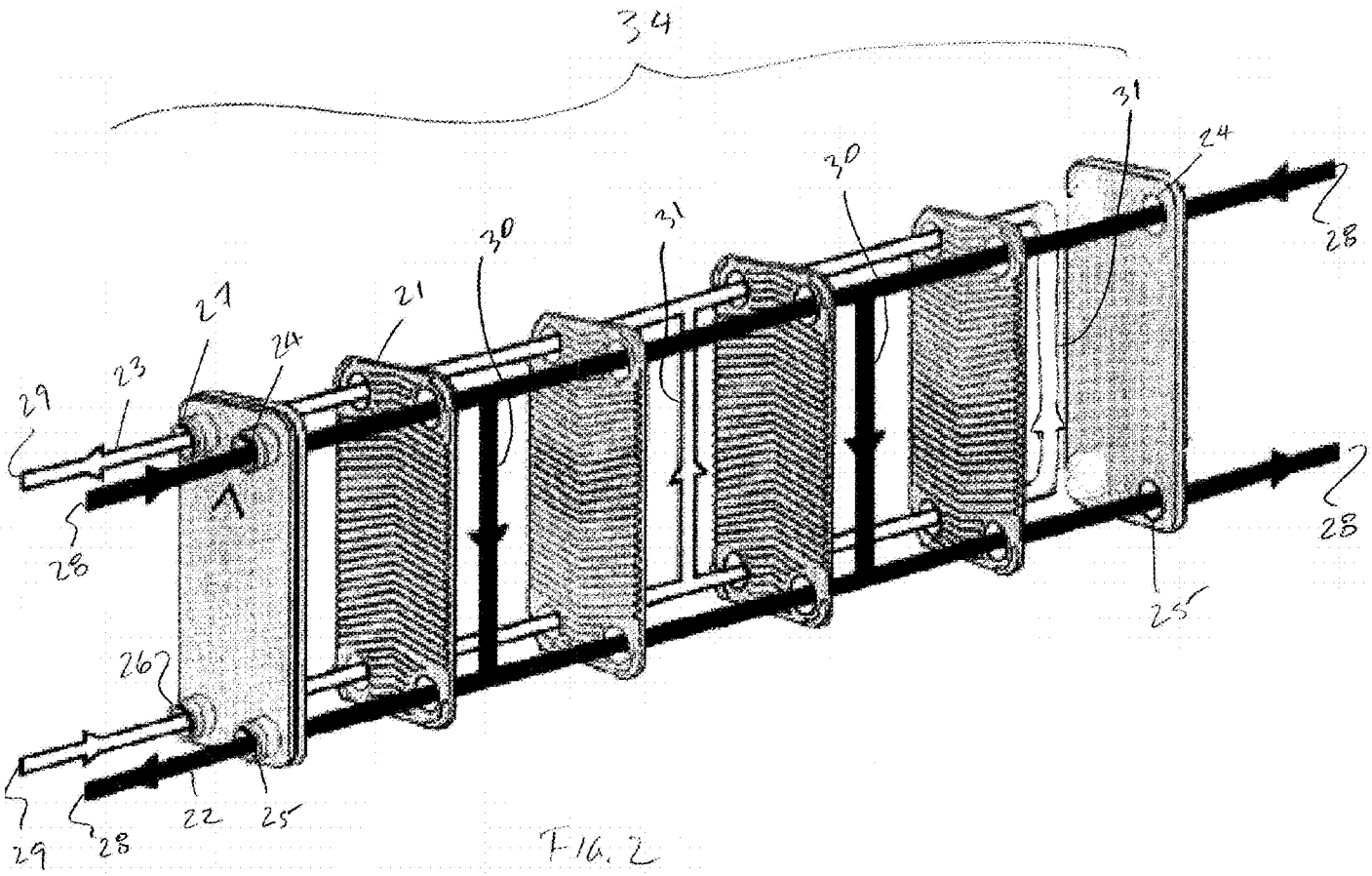
FIG. 2 is a perspective/schematic view of a second embodiment, shown expanded.

In FIG. 2, a second embodiment of the invention is illustrated. In this embodiment, as in the previous embodiment, first fluid refrigerant 22 enters the heat exchanger 34 at two entrance points 24, on opposite sides of the heat exchanger. However, in this embodiment, the refrigerant exits the heat exchanger at two first fluid outlet ports 25.

It has been discovered that in both the dual inlet/single outlet, and dual inlet/double outlet embodiments, the prior art problem of maldistribution of refrigerant temperatures and flow with resulting maldistribution of heat throughout a plate heat exchanger is reduced or eliminated. Heat is thereby more efficiently exchanged across the length and breadth of each heat exchanging plate 21, which ultimately results in a reduced-size plate heat exchanger having the same heat exchange capacity as a physically larger plate heat exchanger of the same configuration. Reductions in pressure drop through the exchanger is also realized by this configuration.

Figure 3:
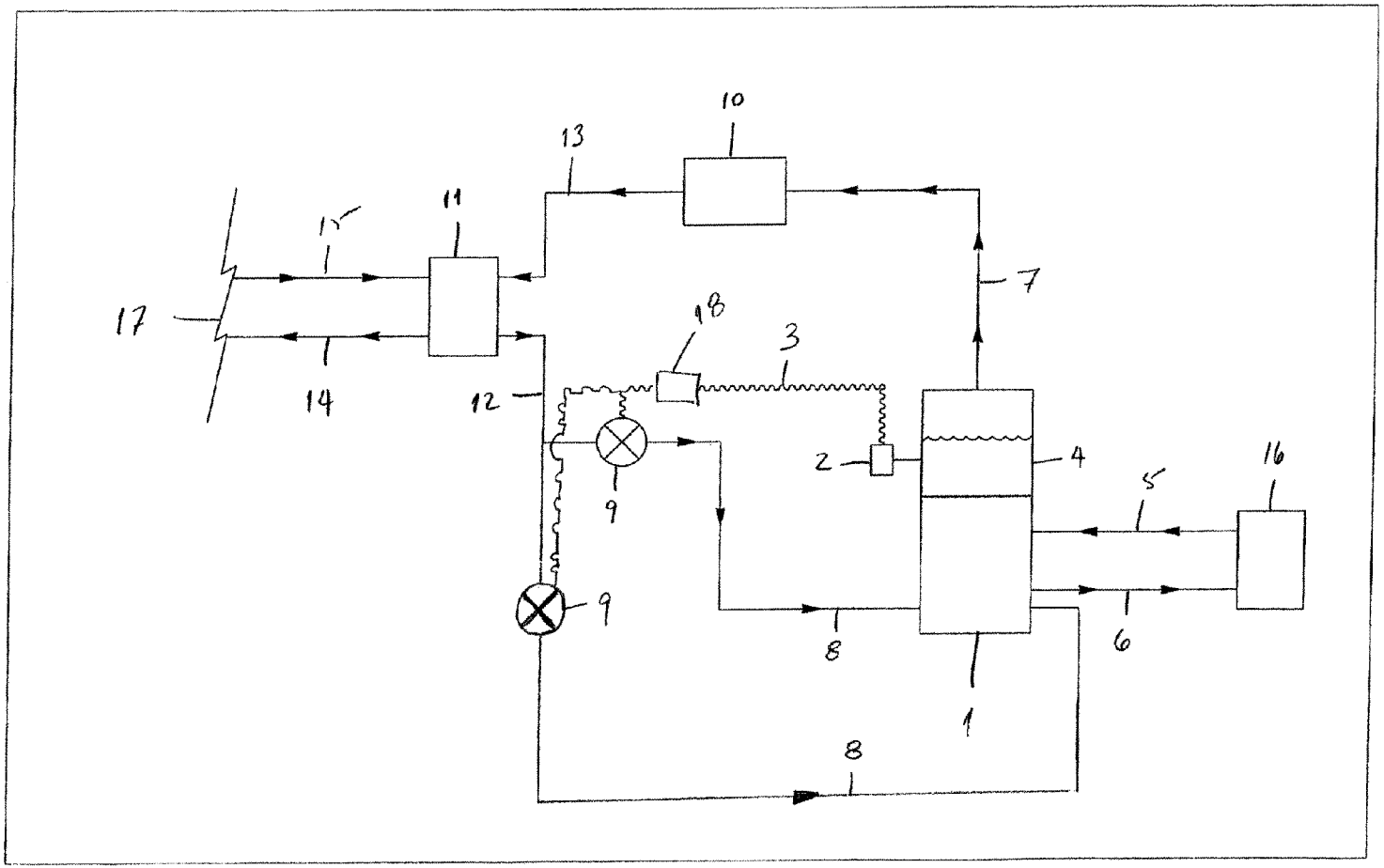
FIG. 3 is a schematic view of the invention employed in a vapor compression refrigeration cycle.

FIG. 3 sets out a dual inlet two chamber plate heat exchanger having an additional chamber for accepting and controlling refrigerant or other fluid in two thermodynamic phases—gas and liquid. The invention further sets out a system for utilizing and controlling the fluid in the system.

The inventive dual inlet two chamber plate heat exchanger may be advantageously employed as an evaporator for refrigerant in a closed-loop vapor compression refrigerant cycle.

Referring to FIG. 3, a vapor compression refrigeration cycle including the present invention is shown.

Refrigerant 11 is condensed to a liquid state 12 in the condenser element 11 before exposure to the expansion valves 9. The expansion valves 9 may be controlled as set out below.

Heat is vented to atmosphere 17 via the warm fluid 14 cool fluid 15 loop.

The condensed refrigerant 8 is split into two paths before introduction to the dual inlet heat exchanger.

Depending on the position of the expansion valves 9, the thermodynamic condition of the condensed refrigerant 8 is, variously, entirely in liquid state, or a two-phase liquid vapor state. It is introduced into the plate heat exchanger 1 which together with the secondary or auxiliary vessel 4 forms the evaporative heat exchanger apparatus of the present invention.

The refrigerant in the secondary vessel or auxiliary vessel 4 may be in liquid phase, gas phase, and/or a mixed liquid gas phase.

The secondary vessel 4 may be arranged above or on top of the evaporative plate heat exchanger 1.

Liquid refrigerant 8 is introduced into the evaporative plate heat exchanger 1 at or near a bottom portion of the exchanger 1. Warm fluid 5 from the building load 16 which is to be chilled via the phase change of the refrigerant in the evaporative plate heat exchanger 1 and returned in the chilled fluid leg 6 is introduced into the exchanger 1. Because the secondary vessel 4 is arranged to accommodate the gas and non-gas phases of this refrigerant, the evaporative plate heat exchanger 1 can be more effectively utilized to exchange heat from the building load 16 to the refrigerant 8. Specifically, there is no need to allow empty space at the top of the evaporative plate heat exchanger 1 to ensure that no liquid leaves the exchanger en route to the compressor 10 inlet, because the inventive element of the secondary vessel 4 is specifically arranged to perform the function of holding and managing the gas and non- gas phase refrigerant. In this way, the entire surface area of the evaporative plate heat exchanger 1 can be utilized to exchange heat from the building load 16 to the refrigerant 8. Element 13 shows compressed refrigerant leaving the compressor 10.

In one embodiment, a fluid connection is arranged from the bottom of the secondary vessel 4 to the top of the evaporative plate heat exchanger 1, in order to communicate the refrigerant between the secondary vessel and the heat exchanger.

The evaporated refrigerant 7 travels through the secondary vessel 4 and exits at the top of the vessel 4. The system is arranged to ensure that any gas-phase refrigerant 7 exits the secondary vessel 4, while liquid and two-phase fluids remain in the secondary vessel 4, to be delivered back into the evaporative plate heat exchanger 1 for evaporation, in a closed-loop manner.

A secondary vessel liquid level sensor 2 monitors the level of liquid in the secondary vessel 4, and sends a corresponding liquid level signal 3 back to the expansion valve controller 18. The liquid level signal 3 indicates to the controller 18 whether to variably open or close the expansion valves 9, in order to supply essentially liquid or gas phase refrigerant to the evaporative plate heat exchanger 1.

The expansion valve controller 18/expansion valves 9 assembly is arranged to adjust the thermodynamic characteristics of the refrigerant 12, 8 in order to supply the secondary valve 4/ evaporative plate heat exchanger 1 structure with refrigerant 8 in a condition which is determined to be required for most effective and efficient heat transfer, and energy consumption in the form of compressor work.

The secondary valve 4/evaporative plate heat exchanger 1 structure may be utilized in connection with dedicated heat recovery chillers, heat pump systems, and/or conventional chiller refrigeration cycles.

The invention claimed is:

1. A plate heat exchanger for exchanging heat between two fluids, comprising:

a plurality of heat exchanging plates arranged adjacent one another and forming a plate heat exchanger, a first fluid being a refrigerant, a second fluid for transferring heat to said first fluid in said heat exchanger, at least two first fluid inlet ports, at least one first fluid outlet port, at least one second fluid inlet port, at least one second fluid outlet port, a first fluid flow path, a second fluid flow path, said first fluid flow path comprising a plurality of first fluid heat exchanging flow paths, said second fluid flow path comprising a plurality of second fluid heat exchanging flow paths, each of said first and second heat exchanging flow paths being separated by a heat exchanging plate and each being disposed in a gap between said heat exchanging plates, each of said first fluid inlet ports being disposed on opposite distal sides of said plate heat exchanger positioned at a common inlet corner along a first fluid edge of the heat exchanger and being aligned facing each other linearly, such that the first fluid entering from each of said first fluid inlet ports is on a linearly aligned collision path before travelling through the heat exchanger, the first fluid outlet port being disposed at a corner distal to said common inlet corner along said first fluid edge of the heat exchanger, said second fluid ports being disposed along a second fluid edge of the heat exchanger which is distal to and parallel with said first fluid edge said first fluid being introduced into said heat exchanger through said at least two first fluid inlet ports, said at least two first fluid inlet ports being in fluid communication with a common inlet region of each of said first fluid flow paths, wherein pressure and temperature differentials of entering first fluid are controlled and optimized, and maldistribution of temperature and flow is controlled and minimized.

2. A plate heat exchanger according to claim 1, further comprising at least two first fluid outlet ports.

3. A plate heat exchanger according to claim 1, having a single second fluid inlet port.

4. A plate heat exchanger according to claim 1, having a single second fluid outlet port.

* * * * *